US006234937B1

(12) United States Patent
Yu

(10) Patent No.: US 6,234,937 B1
(45) Date of Patent: May 22, 2001

(54) FOLDING STRUCTURE OF AN EXERCISER

(75) Inventor: Te Liang Yu, Tai Ping (TW)

(73) Assignee: Alilife Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 09/598,913

(22) Filed: Jun. 22, 2000

(51) Int. Cl.[7] ..... A63B 22/00
(52) U.S. Cl. ..... 482/54
(58) Field of Search ..... 482/54, 51, 52, 482/53

(56) References Cited

U.S. PATENT DOCUMENTS 6,042,515 * 3/2000 Wang ..... 482/54
6,179,753 * 1/2001 Barker et al. ..... 482/54

* cited by examiner

*Primary Examiner*—Stephen R. Crow
(74) *Attorney, Agent, or Firm*—Rosenberg, Klein & Lee

(57) ABSTRACT

Folding structure of an exerciser including a frame body and a support stand. The support stand has two support legs on two sides of the frame body. The inner sides of the support legs are respectively disposed with a large arch plate and a small arch plate positioned under the large arch plate. The large and small arch plates define an arch rail therebetween. An arch projecting block is disposed on each long side of the frame body for slidably fitting in the arch rail. When folding or unfolding the exerciser, a pressure is exerted onto the frame body. At this time, one side of the arch projecting block is pressed against one end of the top face of the small arch plate to form a supporting point, while the other side of the arch projecting block abuts against one end of the bottom face of the large arch plate to form another supporting point.

2 Claims, 6 Drawing Sheets

FOLDING STRUCTURE OF AN EXERCISER

BACKGROUND OF THE INVENTION

The present invention relates to a folding structure of an exerciser including a frame body and a support stand. The support stand is disposed with a large arch plate and a small arch plate defining an arch rail for an arch projecting block of the frame body to slidably fit in the arch rail.

FIGS. 5 and 6 show a conventional running exerciser composed of a support stand 91 and a frame body 92. A rail 911 is mounted at top end of the support stand 91. Two inner sides of the bottom end of the support stand 91 are respectively disposed with two sleeves 912. Two roller shafts 93 are respectively disposed at front and rear ends of the frame body 92. A running belt 94 is wound on the roller shafts 93. A plane board 95 is mounted on inner side of the running belt 94. Two pivot shafts 921 are respectively disposed on two sides of front end of the frame body 92 for pivotally connecting with the sleeves 912 of the support stand 91. Accordingly, the support stand 91 can be pivotally rotated and folded to reduce the room for storage of the running exerciser and facilitate transfer thereof.

However, the pivot shafts 921 are concentrically pivotally connected with the sleeves 912. Therefore, when a user runs on the running exerciser, the frame body 92 suffers from the gravity and the pressure exerted by the pivot shafts 921 of the frame body 92 onto the sleeves 912 will concentrate on one line. Also, when the user runs on the running belt 94, the frame body 92 is vibrated and the pivot shafts 921 and the sleeves 912 will exert a frictional force onto each other. Therefore, the bottom edges of the pivot shafts 921 suffer a downward pressure on one line and only this line is abraded under pressure. As a result, the components tend to deform and loosen after a period of use.

Moreover, when installed, the left and right pivot shafts 921 of the frame body 92 are respectively assembled with the left and right sleeves 912 of the support stand 91 and then the rail 911 is assembled. Such assembling procedure is troublesome and the production efficiency is lowered.

SUMMARY OF THE INVENTION

It is therefore a primary object of the present invention to provide a folding structure of an exerciser including a frame body and a support stand. The support stand has two support legs on two sides of the frame body. The inner sides of the support legs are respectively disposed with a large arch plate and a small arch plate defining an arch rail therebetween for an arch projecting block of the frame body to slidably fit in. The pressure exerted onto the frame body during exercising is distributed and supported by two supporting points formed at the inner edge of the large arch plate and the outer edge of the small arch plate. Therefore, the supporting force is enhanced and the frictional force is distributed.

According to the above object, the exerciser of the present invention includes a frame body and a support stand. Two roller shafts are respectively disposed at front and rear ends of the frame body. A running belt is wound on the roller shafts. A plane board is mounted on inner side of the running belt. A rail is mounted at top end of the support stand. The support stand includes two support legs on two sides of the frame body. The inner sides of the support legs are respectively disposed with a large arch plate and a small arch plate positioned under the large arch plate. The large and small arch plates define an arch rail therebetween. An arch projecting block is disposed on each long side of the frame body for slidably fitting in the arch rail.

The present invention can be best understood through the following description and accompanying drawings wherein:

DETAILED DESCRIPTION OF THE PREFERRED EMBODIMENT

Figure 1:
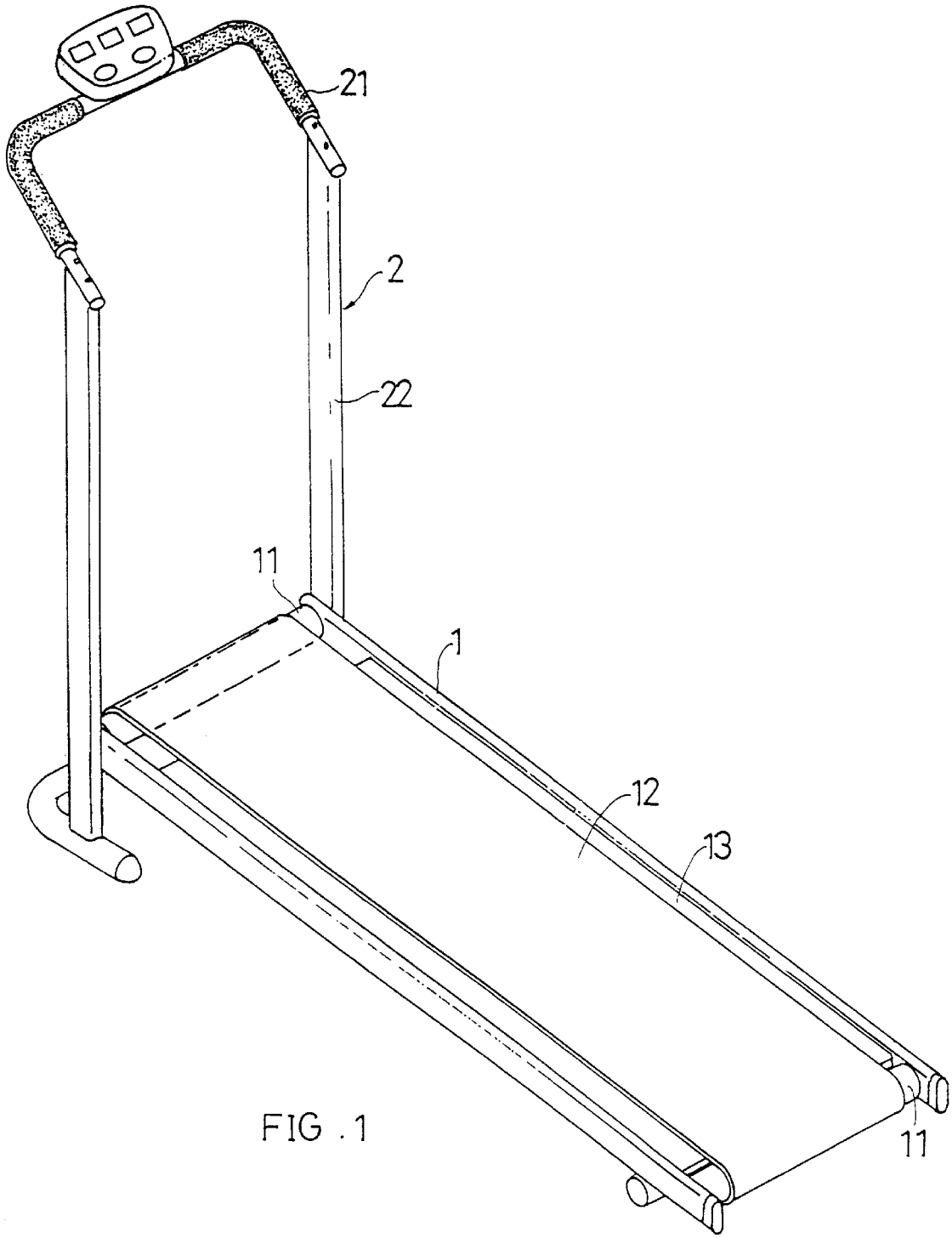
FIG. 1 is a perspective view of the present invention.
Figure 2:
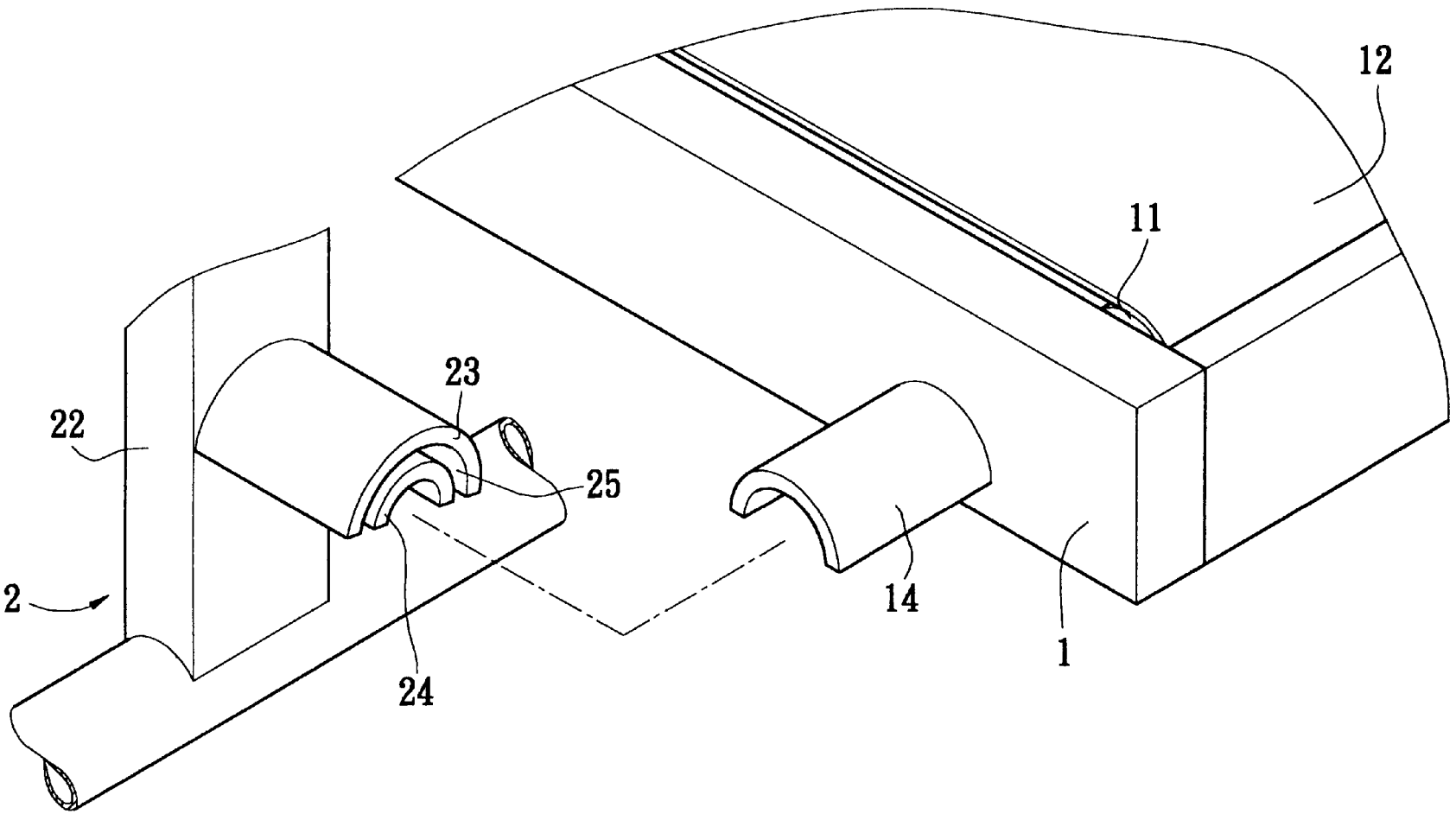
FIG. 2 is a perspective view of a part of the present invention, showing the large and small arch plates and the arch projecting block thereof.
Figure 3:
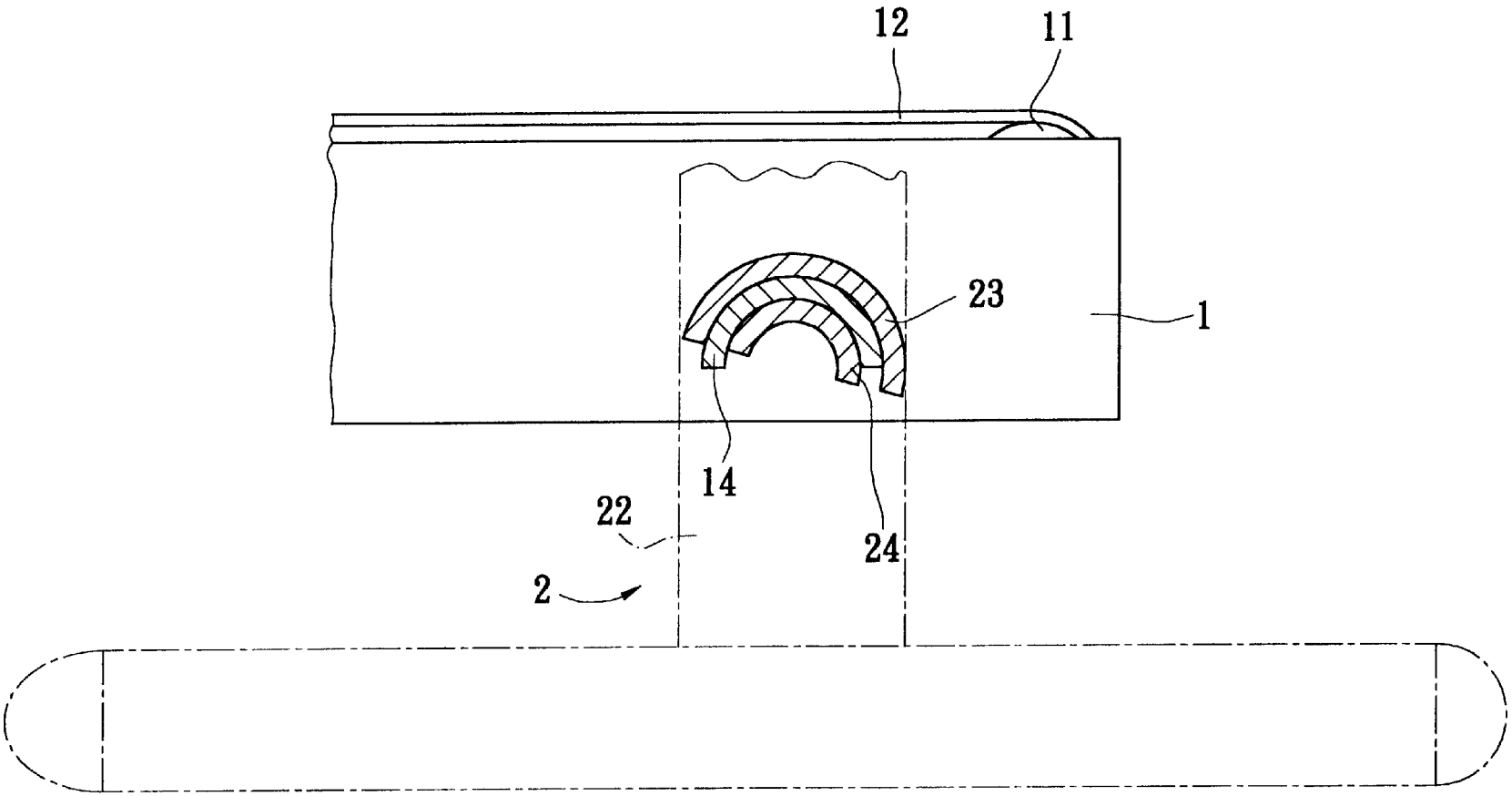
FIG. 3 is a partially sectional view of the present invention, showing the operation thereof in one state.
Figure 4:
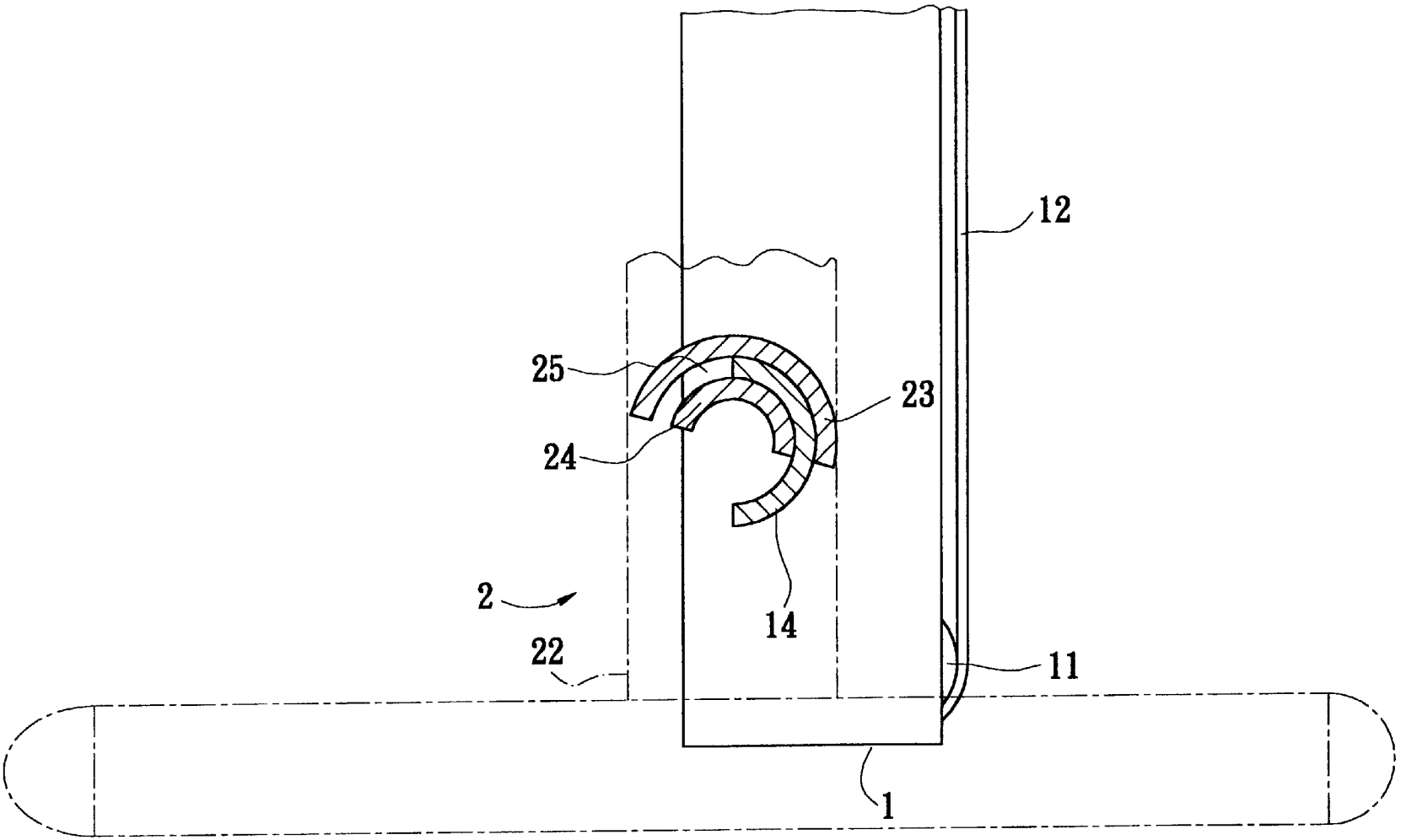
FIG. 4 is a partially sectional view of the present invention, showing the operation thereof in another state.
Figure 5:
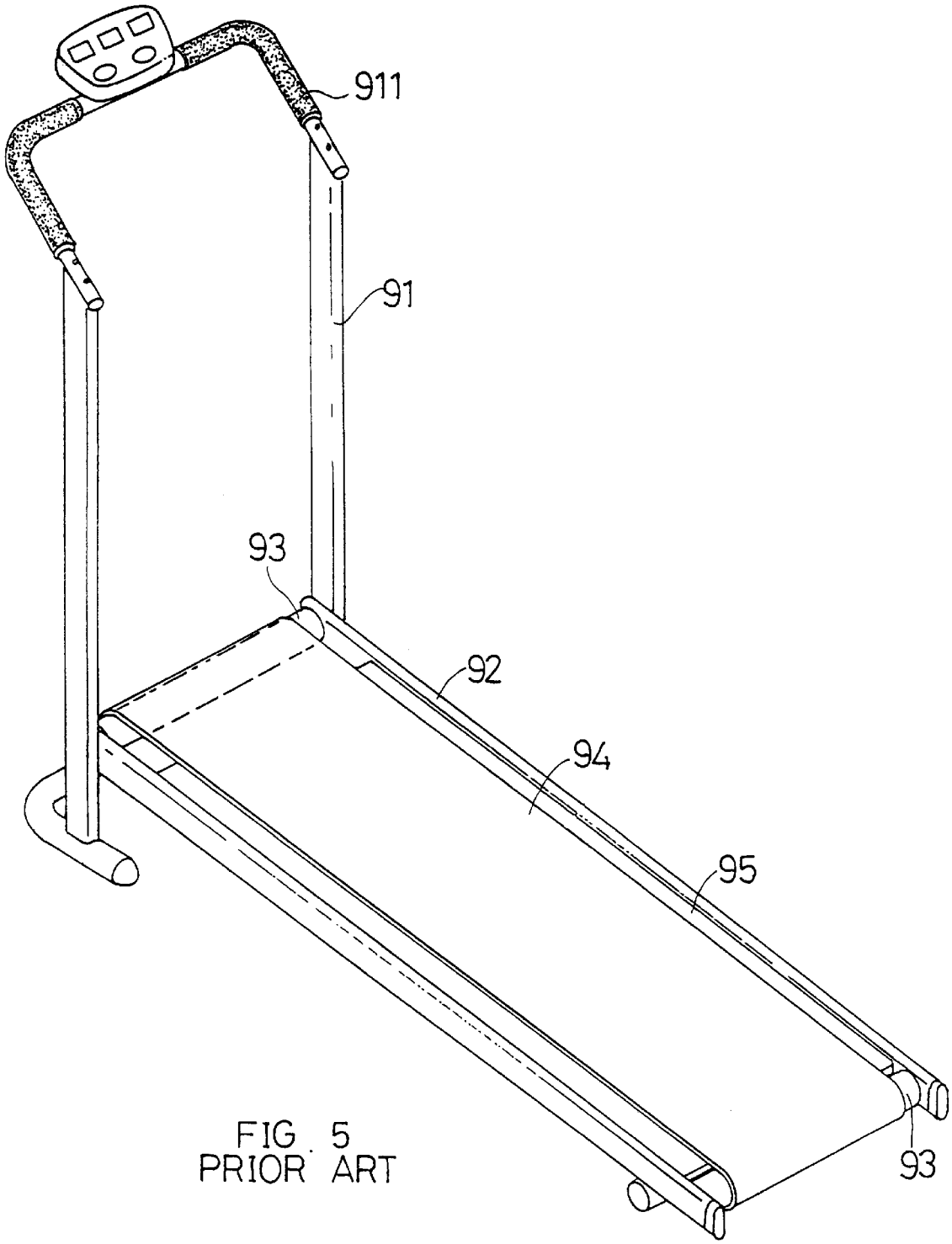
FIG. 5 PRIOR ART
FIG. 5 is a perspective view of a conventional exerciser.
Figure 6:
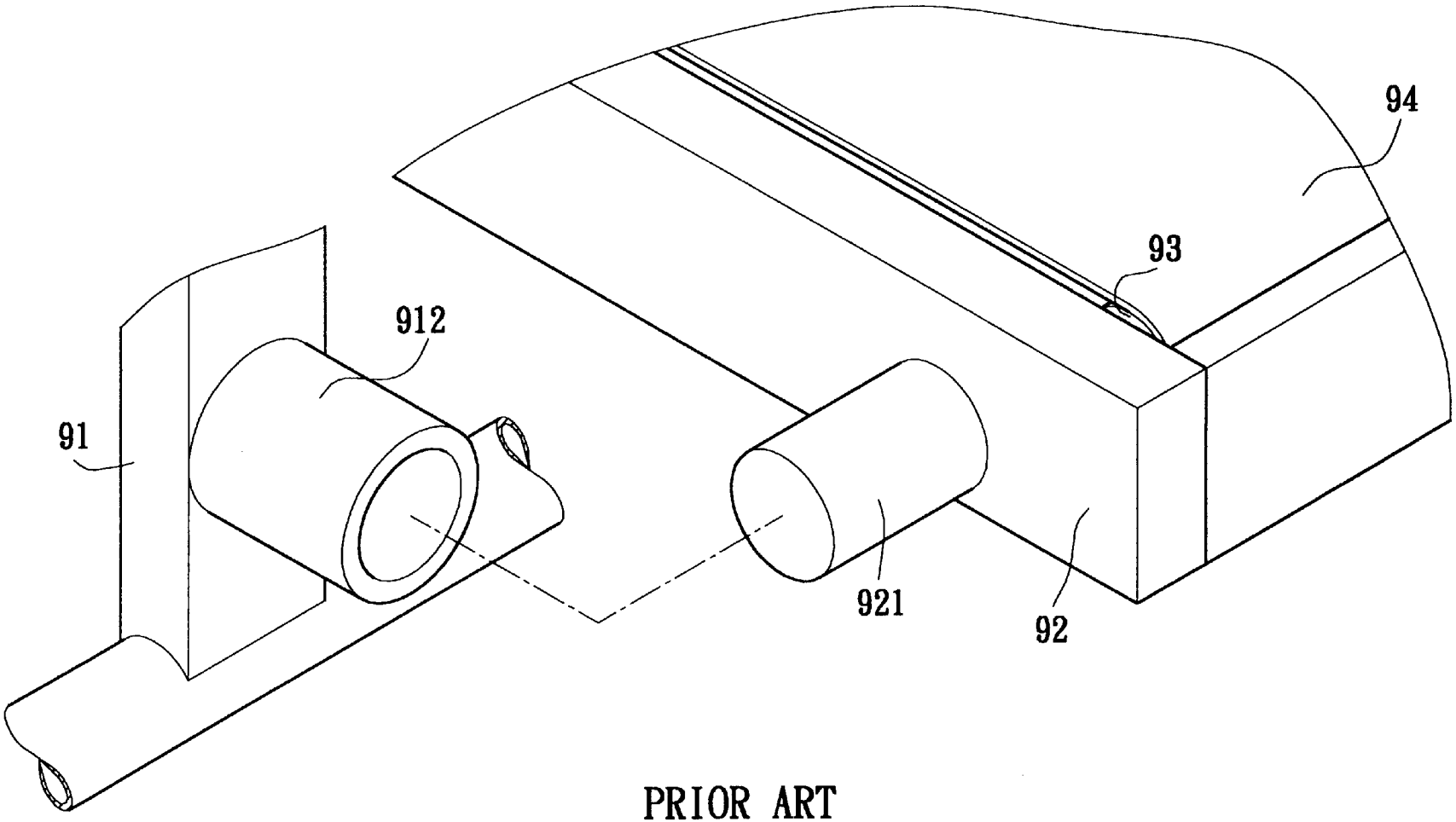
PRIOR ART FIG. 6
FIG. 6 is an enlarged view of a part of the conventional exerciser, showing the folding structure thereof.

Please refer to FIGS. 1 to 4. The present invention provides a folding structure of an exerciser. The exerciser includes a frame body 1 and a support stand 2. Two roller shafts 11 are respectively disposed at front and rear ends of the frame body 1. A running belt 12 is wound on the roller shafts 11. A plane board 13 is mounted on inner side of the running belt 12. A rail 21 is mounted at top end of the support stand 2. The support stand 2 includes two support legs 22 on two sides of the frame body 1. The inner sides of the support legs are respectively disposed with a large arch plate 23 and a small arch plate 24 positioned under the large arch plate 23. The large and small arch plates 23, 24 define an arch rail 25 therebetween. An arch projecting block 14 is disposed on each long side of the frame body 1 for slidably fitting in the arch rail 25.

The support legs 22 and pivotally connected with the frame body 1 by means of the semicircular arch faces of the arch rail 25 and the arch projecting block 14. After connected, a gap exists between the arch rail 25 and the arch projecting block 14. When the frame body 1 suffers a downward force, the arch projecting block 14 is depressed. At this time, one side of the arch projecting block 14 is pressed against the small arch plate 24 to form a supporting point at the outer edge of the small arch plate 24, while the other side of the arch projecting block 14 will be raised to form a supporting point at the inner edge of the large arch plate 23. The two supporting points can effectively bear the pressure exerted onto the frame body 1 when a user runs on the running belt 12 and distribute the frictional force.

The arch projecting block 14 of the frame body 1 is slidably fitted in the arch rail 25 of the support leg 22. Therefore, the support stand 2 can be first assembled and then the arch rail 25 can be directly aimed at the arch projecting block 14 and mounted along the arch face thereof. Therefore, it is no more necessary to respectively assemble the left and right support legs and then assemble the rail. Accordingly, by means of the design of the arch rail 25, the assembling time is shortened and the assembling procedure is simplified.

In conclusion, when the arch projecting block 14 is forced and pressed against the arch rail 25, the force is distributed into two supporting points rather than one line as the pivot shafts and sleeves of the conventional device. Therefore, the arch face design is able to effectively enhance the supporting force and when the arch projecting block 14 is slided along the arch rail 25, the frictional force is effectively distributed.

The above embodiment is only used to illustrate the present invention, not intended to limit the scope thereof. Many modifications of the above embodiment can be made without departing from the spirit of the present invention.

What is claimed is:

1. Folding structure of an exerciser, the exerciser including a frame body and a support stand, two roller shafts being respectively disposed at front and rear ends of the frame body, a running belt being wound on the roller shafts, a plane board being mounted on inner side of the running belt, a rail being mounted at top end of the support stand, the support stand including two support legs on two sides of the frame body, inner sides of the support legs being respectively disposed with a large arch plate and a small arch plate positioned under the large arch plate, the large and small arch plates defining an arch rail therebetween, an arch projecting block being disposed on each long side of the frame body for slidably fitting in the arch rail.

2. Folding structure of an exerciser as claimed in claim 1, wherein the large and small arch plates and the arch projecting block are substantially 180 degree arch plates.

* * * * *